US006942210B2

(12) United States Patent
Kawasumi

(10) Patent No.: US 6,942,210 B2
(45) Date of Patent: Sep. 13, 2005

(54) SHEET FEEDING APPARATUS AND IMAGE FORMING APPARATUS

(75) Inventor: Ryoichi Kawasumi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 10/404,445

(22) Filed: Apr. 2, 2003

(65) Prior Publication Data

US 2003/0189282 A1 Oct. 9, 2003

(30) Foreign Application Priority Data

Apr. 5, 2002 (JP) ..... 2002-103941

(51) Int. Cl.[7] ..... B65H 3/52

(52) U.S. Cl. ..... 271/125; 271/121; 271/122; 271/124

(58) Field of Search ..... 271/121, 122, 271/124, 125; 226/176, 177, 186, 187; 242/419.5, 419.9

(56) References Cited

U.S. PATENT DOCUMENTS 4,000,762 A * 1/1977 Mizuno ..... 139/452
4,288,068 A * 9/1981 Hashimoto et al. ..... 271/125
4,496,145 A * 1/1985 Fukui ..... 271/122
4,515,358 A * 5/1985 Fukui ..... 271/122
4,546,963 A * 10/1985 Dinnissen ..... 271/35
4,586,705 A * 5/1986 Satoh et al. ..... 271/122
4,817,886 A * 4/1989 Yoshioka et al. ..... 242/332.2
4,852,868 A * 8/1989 Fukui et al. ..... 271/122
5,217,152 A * 6/1993 Suzuki et al. ..... 226/25
5,449,162 A * 9/1995 Saito et al. ..... 271/122
5,500,726 A * 3/1996 Aoyama et al. ..... 399/339
5,651,542 A * 7/1997 Yamauchi et al. ..... 271/122
5,678,817 A * 10/1997 Saito et al. ..... 271/122
5,692,743 A * 12/1997 Yano et al. ..... 271/121
5,996,990 A * 12/1999 Kawashima ..... 271/122
6,000,689 A * 12/1999 Furuki et al. ..... 271/10.11
6,102,388 A * 8/2000 Thornhill ..... 271/119
6,467,767 B2 * 10/2002 Yano ..... 271/122
6,581,925 B1 * 6/2003 Shea et al. ..... 271/125
6,595,512 B2 * 7/2003 de Koning et al. ..... 271/125

FOREIGN PATENT DOCUMENTS

JP 06263280 A * 9/1994 ..... B65H/3/52

* cited by examiner

*Primary Examiner*—Donald P. Walsh
*Assistant Examiner*—Matthew J. Kohner
(74) *Attorney, Agent, or Firm*—Fitzpatrick, Cella, Harper & Scinto

(57) ABSTRACT

A sheet feeding apparatus according to the present invention includes: a feed rotary member rotationally driven in a sheet feeding direction; a retard rotary member in contact with the feed rotary member under a predetermined pressure and rotationally driven in a direction opposite to the sheet feeding direction with a predetermined torque; and a pressure fluctuation restraining device for diminishing a change in a contact pressure of the retard rotary member for the feed rotary member generated at the time of drive transmission to the retard rotary member.

6 Claims, 10 Drawing Sheets

SHEET FEEDING APPARATUS AND IMAGE FORMING APPARATUS

BACKGROUND OF THE INVENTION

1. Field of the Invention

The present invention relates to a sheet feeding apparatus for feeding sheets, such as originals and recording paper, to an image forming apparatus, such as a copying machine, a printer, or a facsimile apparatus.

2. Related Background Art

Some conventional copying machines or the like are equipped with a retard separation type automatic sheet feeding apparatus in which sheets serving as recording paper and are accommodated in a sheet cassette or the like are sent out one by one through a feed roller rotating in the sheet feeding direction and a retard roller capable of reverse rotation. An example of such a conventional sheet feeding apparatus will be described with reference to drawings. FIGS. 4 through 6 are diagrams showing a retard separation type sheet feeding apparatus, of which FIG. 4 is an explanatory sectional view of a sheet feeding means, FIG. 5 is a perspective view showing a drive transmission portion for driving the sheet feeding means, and FIG. 6 shows a main portion of the sheet feeding means.

The sheet feeding means 1 is equipped with a deck 5 for accommodating sheets S, a pick-up roller 2 for sending out sheets S from the deck 5, and a pair of sheet feeding rollers 3 and 4, which is made up of a feed roller 3 and a retard roller 4. Reference numeral 15 indicates a torque limiter for transmitting a torque of a predetermined torque value or less. The feed roller 3 is normally caused to rotate in the sheet feeding direction (the direction indicated by the arrow A in FIG. 5) through a feed roller shaft 11, and a rotational force in a direction opposite to the sheet feeding direction (i.e., the direction indicated by the arrow B in FIG. 5) is transmitted to the retard roller 4 through a retard roller shaft 13 and the torque limiter 15. The sheets sent out by the pick-up roller 2 are guided to the pair of sheet feeding rollers 3 and 4 by guides 7 and 8, and are separated from each other by the pair of sheet rollers 3 and 4 to be conveyed by a conveying roller pair 6 while being guided by a guide 9.

When the pick-up roller 2 feeds one sheet S from the deck 5, the torque limiter 15 makes idle rotation due to the frictional force between the sheet S and the feed roller 3, and the rotational force of the retard roller 4 in the direction of the arrow B is interrupted. Thus, the retard roller 4 follows the feed roller 3 to rotate therewith, thus feeding the sheet S.

When the pick-up roller 2 feeds a plurality of sheets S, the frictional force between the sheets S is smaller than the frictional force between the sheets S and the feed roller 3, so that the retard roller 4 rotates in the direction of the arrow B to restore the sheets to the interior of the deck 5 except for the uppermost sheet.

In FIG. 6, reference numeral 102 indicates a pressurizing arm, which is mounted on a support member 100 fixed to the apparatus main body and rotates around a pivot 102A. Reference numeral 101 indicates a spring. A pressurizing force due to the spring 101 causing the pressurizing arm to rotate around the pivot 102A is applied to the retard roller 4, providing a contact pressure for the feed roller 3. Together with the idle rotation torque T of the torque limiter 15, this contact pressure constitutes an important parameter determining "double feeding" and "slippage" of the sheets being fed. In the following, the phenomenon in which a plurality of sheets are fed simultaneously into the main body of the image forming apparatus due to the failure of the pair of sheet feeding rollers 3 and 4 to effect sheet separation, will be referred to as "double feeding", and the phenomenon in which the sheets are not fed beyond the pair of sheet feeding rollers 3 and 4 will be referred to as "slippage".

FIG. 7 is an explanatory diagram illustrating a feeding area involving no double feeding or slippage. In the drawing, the horizontal axis indicates the idle rotation torque T of the torque limiter 15, and the vertical axis indicates the pressurizing force N (contact pressure) of the retard roller 4, with the shaded portion indicating the feeding area where separate feeding of the sheets is possible.

Thus, assuming that, a predetermined value T1 is set in FIG. 7 for the idle rotation torque of the torque limiter 15 in order to prevent "double feeding" and "slippage", it can be understood that the contact pressure is restricted to the range as defined by the resultant intersections N1 and N2 and the border lines (3) and (5). Thus, the value of the contact pressure is a very important parameter in determining the feeding area. Further, this contact pressure fluctuates upon drive input to the pair of sheet feeding rollers 3 and 4.

Here, the theory on the fluctuation in the contact pressure of the retard roller 4 for the feed roller 3 will be described in detail. First, in FIG. 5, the arrow a indicates the direction in which sheets are sent out. Due to the rotational force of the retard roller 4 in the direction of the arrow B, a return force due to the torque limiter 15 (in the direction opposite to the arrow a) is applied to the feed roller 3. As shown in FIG. 6, as the reaction force for this return force, at the point on the outer peripheral surface of the retard roller 4 in contact with the feed roller 3, a force F1 acts in the sheet feeding direction. The forces caused to act by this force F1 are mentioned below. It is assumed here that the point of action of the force applied to the retard roller 4 during drive is not on the outer peripheral surface of the rotating roller but at the roller center.

F1: the reaction force of the return force of the retard roller 4 (=T/r)

F2: the offset force of the force F1

F3: the tangential component of F2 around the center of pivotal movement of the rotating arm 102

Na: the component of F3 directed to the center of the feed roller 3

$$Na=(T/2r)\sin 2\theta \tag{1}$$

where

T: the idle rotation torque of the torque limiter;

r: the effective radius of the of the retard roller (which is defined as the actual distance from the retard roller center to the outer peripheral surface of the feed roller); and θ: the angle of pivot of the pressurizing arm 102 as measured from the line of action of F2.

The action force Na is defined as the fluctuation pressure Na of the retard roller 4. Thus, under static state, it is related to the contact pressure (static pressure) as follows (as shown in FIG. 8):

$$\text{Contact pressure under dynamic state (dynamic pressure)}=\text{contact pressure under static state (static pressure)}+\text{fluctuation pressure } Na \tag{2}$$

That is, at the time of drive input, the contact pressure of the retard roller 4 for the feed roller 3 fluctuates due to this fluctuation pressure Na. Here, it is assumed that, in FIG. 6, the angle made by F2 and the line of action connecting the center of the retard roller 4 and the pivotal movement center of the pressurizing arm 102 is θ. In the graph of FIG. 9, the horizontal axis indicates the angle θ, and the vertical axis indicates the fluctuation pressure Na. The graph shows a theoretical value based on equation (1) Here, it is assumed that both the idling torque T of the torque limiter and the effective radius r of the retard roller 4 are fixed.

It can be seen from FIG. 9 that the fluctuation pressure Na can assume a positive or negative value depending upon the angle of pivot θ. Note that, in FIG. 9, when the sign of θ is positive, the sign of Na is also positive.

The relationship expressed by equation (1) and shown in FIG. 9 is restricted to a theoretical value when the effective radius r of the retard roller is fixed. Thus, when the effective radius r of the retard roller 4 is not fixed, that is, when the roller radius can be greatly changed by the pressurizing force applied to the roller surface, as in the case of a roller formed of a sponge or the like or a hollow roller, the relationship is to be indicated by a different curve.

In the graph of FIG. 10, the horizontal axis indicates the angle θ, and the vertical axis indicates the fluctuation pressure Na, showing the measurement results when the material of the retard roller 4 is a sponge. It can be seen from the graph that, as compared with the case in which r is fixed, the degree of inclination of equation (1) is smaller. Apart from this, there may be a case in which the retard roller consists of a rubber roller or the like. In this case, however, due to the small change amount of the effective radius of the rubber roller, the resultant measurement result substantially coincides with the theoretical value in the case shown in FIG. 9, in which the effective radius r is fixed.

The reason why the degree of inclination of the measurement result in FIG. 10 is smaller than that of the theoretical value will be explained. First, upon drive input to the pair of sheet feeding rollers 3 and 4, a fluctuation pressure Na is generated in the contact pressure of the retard roller 4 for the feed roller 3. When the retard roller 4 is formed of a soft material, the roller is crushed by this fluctuation pressure Na, and the center position of the retard roller 4 is displaced, resulting in a change in the effective radius r of the retard roller 4. Assuming that the change amount in this effective diameter r is Δr, the sign of Δr is reverse to that of the fluctuation pressure Na. Here, the spring 101 causes the pressurizing arm 102 to rotate around the pivot 102A to thereby apply a pressurizing force to the retard roller 4, thus providing a contact pressure for the feed roller 3. When the effective radius r of the retard roller 4 is changed by Δr, the displacement amount of the spring 101 is also changed, thus changing the contact pressure for the feed roller 3*a* as well. Assuming that the change amount in contact pressure due to the change in the displacement amount of the spring 101 is ΔNa, Δr and ΔNa are in the following relationship:

$$\Delta Na \approx k \cdot \Delta r \tag{3}$$

where k: the elastic modulus of the spring 101

Since the sign of Δr is reverse to that of the fluctuation pressure Na, ΔNa works so as to cancel the fluctuation pressure Na. That is, this ΔNa constitutes a factor leading to the smaller degree of inclination of equation (1) as compared with the case in which the effective radius of the retard roller 4 is fixed.

It can be seen from this that, in the conventional sheet feeding apparatus, the contact pressure of the retard roller 4 for the feed roller 3 fluctuates upon drive input to the pair of sheet feeding rollers 3 and 4.

The sheet S, fed as described above, undergoes image forming processes in the copying machine, such as development, transfer, and fixing before it is discharged.

Note that, in the above-described conventional technique, in which the contact pressure of the retard roller 4 for the feed roller 3 fluctuates upon drive input to the pair of sheet feeding rollers 3 and 4, it can happen, in actuality, that the feeding area shown in FIG. 7 is greatly departed from, which leads to a problem from the viewpoint of a stable sheet feeding condition. For example, assuming that the feeding condition is determined by the point N1 shown in FIG. 7, a change in fluctuation pressure for positive results in the "double feeding area" being entered, with the result that the feeding area is departed from.

Further, while in FIGS. 9 and 10 the fluctuation pressure Na expressed by equation (1) is given, using the angle θ of the pivot 102A of the pressurizing arm 102 as a parameter, it is to be noted that a large degree of inclination of equation (1) means a wide range of fluctuation in the fluctuation pressure Na with respect to the change amount of the angle of pivot of the pressurizing arm 102. Thus, when the influence of variation in the change of the angle due to dimensional tolerance is taken into account, a large degree of inclination of equation (1) leads to a large degree of variation in the fluctuation pressure Na, which means the sheet feeding latitude is so much the less.

SUMMARY OF THE INVENTION

The present invention has been made in view of the above-mentioned problems in the prior art. It is an object of the present invention to reduce the range of fluctuation of the contact pressure of the retard roller for the feed roller generated upon drive input to the sheet feeding roller pair, thereby stabilizing the sheet feeding condition.

According to one aspect of the present invention, a sheet feeding apparatus includes:

a feed rotary member rotationally driven in a sheet feeding direction;

a retard rotary member in contact with the feed rotary member under a predetermined pressure and rotationally driven in a direction opposite to the sheet feeding direction with a predetermined torque; and pressure fluctuation restraining means for diminishing a change in a contact pressure of the retard rotary member for the feed rotary member generated at the time of drive transmission to the retard rotary member.

According to another aspect of the present invention, a sheet feeding apparatus includes:

a feed rotary member rotationally driven in a sheet feeding direction;

a retard rotary member rotationally driven in a direction opposite to the sheet feeding direction with a predetermined torque;

an elastic member for bringing the retard rotary member into press contact to the feed rotary member;

a rotary member support portion for supporting the retard member in a pivotally movable manner so as to allow it to come into contact with and be moved away from the feed rotary member;

an elastic member support portion for supporting the elastic member so as to allow an elastic force of the elastic member to be changed; and pressure fluctuation restraining means for operating the elastic member support portion in association with the pivotal movement of the rotary member support portion that takes place at the time of drive transmission to the retard rotary member to change the elastic force of the elastic member so as to diminish a change in a contact pressure of the retard rotary member for the feed rotary member.

According to another aspect of the present invention, a sheet feeding apparatus includes:

a feed roller rotationally driven in a sheet feeding direction;

a retard roller to which drive is transmitted through a torque limiter and which is rotationally driven in a direction opposite to the sheet feeding direction with a predetermined torque;

a roller support member supporting the retard roller and provided to be pivotally movable;

a spring support member onto which a spring is hooked and which is provided to be pivotally movable; and a gear train provided between respective pivots of the roller support member and the spring support member and adapted to transmit the pivotal movement of the roller support member to the spring support member, wherein a gear ratio of the gear train is set such that the pivotal movement angle of the spring support member is larger than that of the roller support member.

DESCRIPTION OF THE PREFERRED EMBODIMENTS (First Embodiment)

Figure 1:
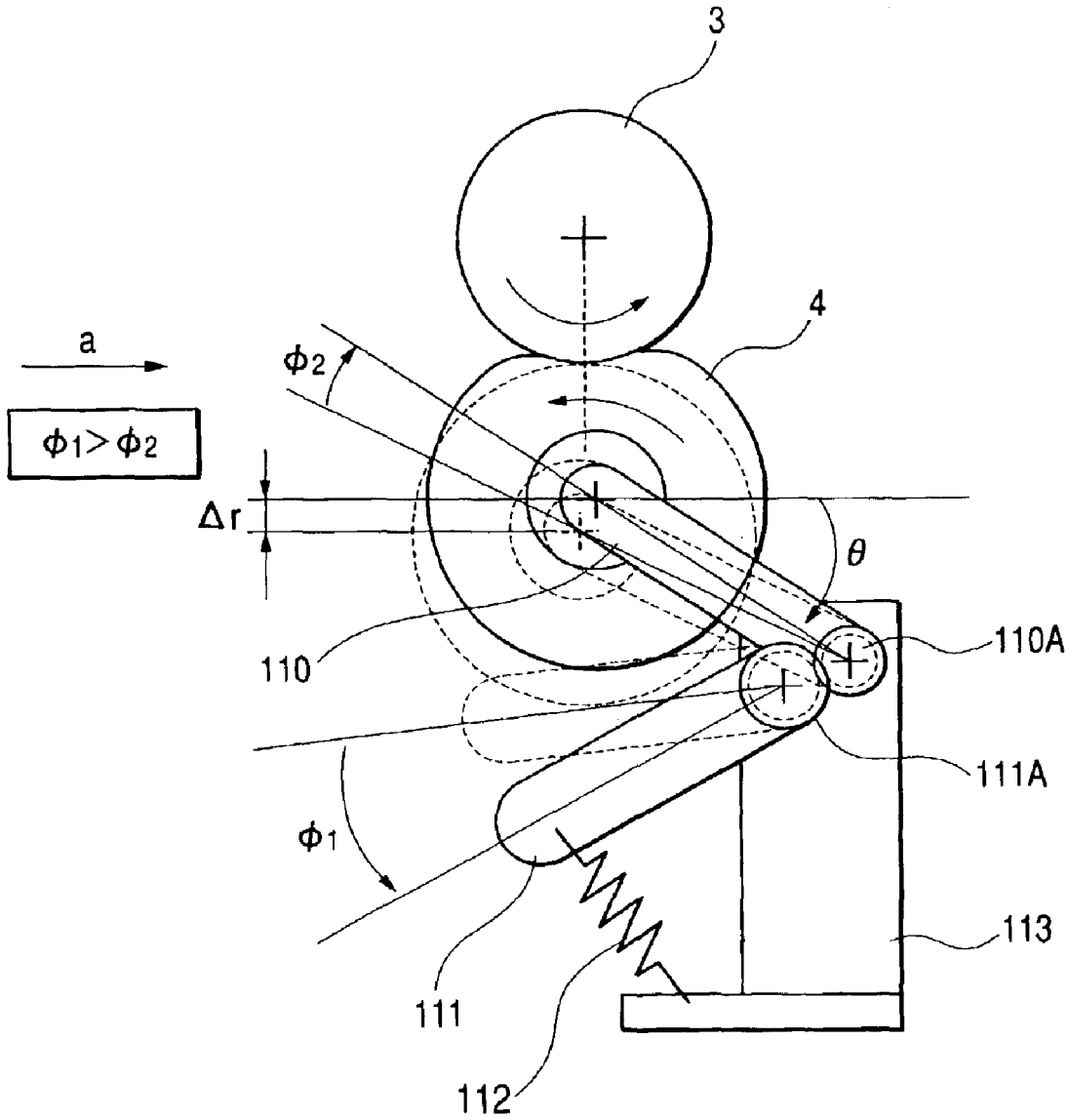
FIG. 1 is a sectional explanatory view of a main portion of a sheet feeding means according to a first embodiment of the present invention.
Figure 3:
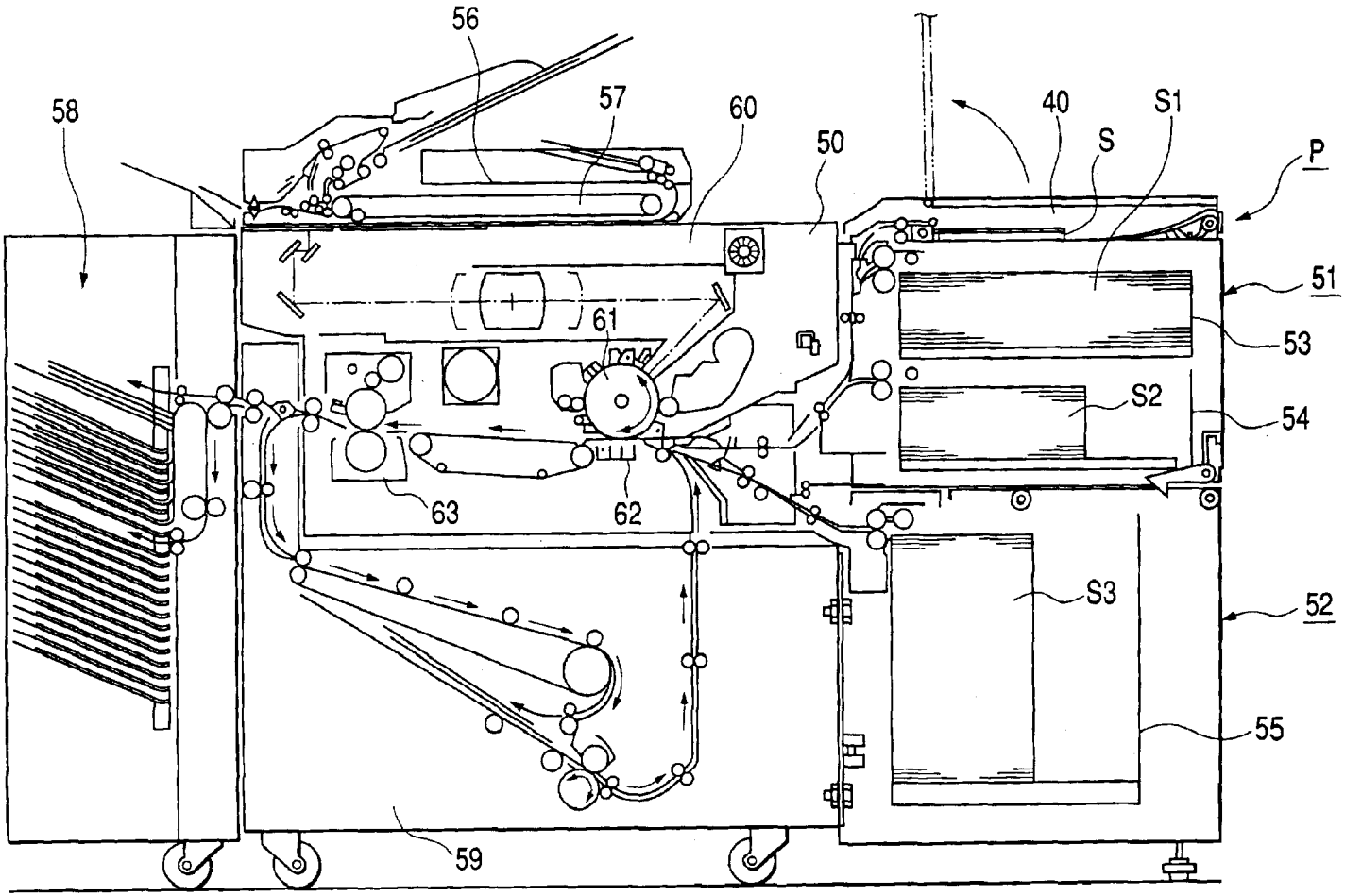
FIG. 3 is a schematic explanatory view of a copying machine equipped with a sheet feeding apparatus according to the present invention.
Figure 4:
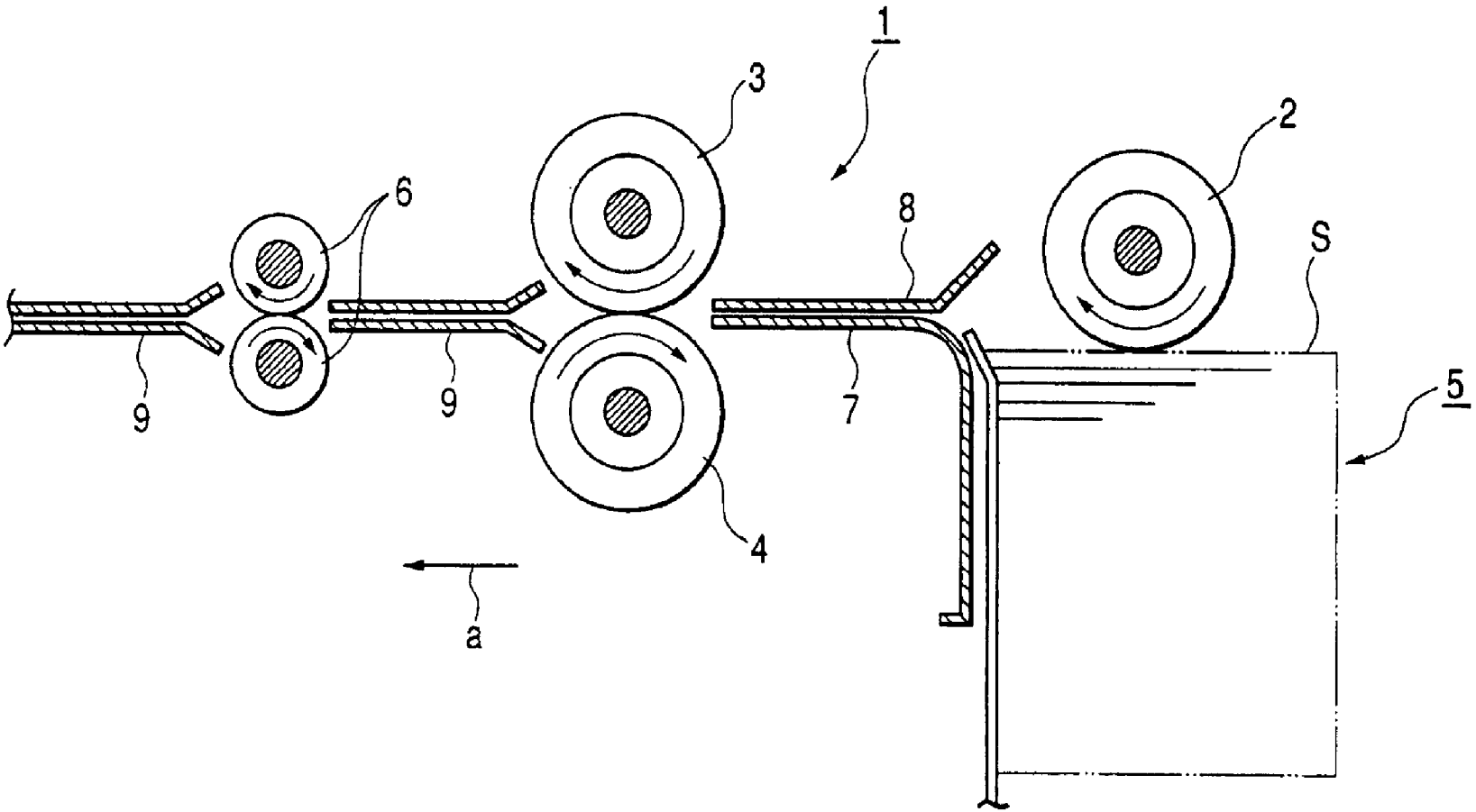
FIG. 4 PRIOR ART
FIG. 4 is a sectional explanatory view showing an example of a conventional sheet feeding means.

A first embodiment of the present invention will now be described with reference to the drawings. FIG. 4, which is a sectional explanatory view showing a sheet feeding means, and FIG. 5, which is a perspective view showing a drive transmission portion for driving the sheet feeding means, are also applicable to this embodiment and will be referred to in the following embodiment. FIG. 1 is a sectional explanatory view of a main portion of a sheet feeding means according to the first embodiment of the present invention. FIG. 3 is a schematic sectional view of a copying machine equipped with a sheet feeding apparatus according to the present invention. The sheet feeding apparatus of the present invention is connected to a main body 50 of a copying machine P serving as an image forming apparatus.

First, the general construction of this image forming apparatus will be described. In FIG. 3, the sheet feeding means is arranged such that sheets S1, S2, and S3 are separated and sent out one by one from decks 53, 54, and 55, respectively. Further, the copying system including the copying machine P is equipped with an original processing apparatus 57 for automatically feeding an original 56 placed on the top portion of the copying machine P, a copy paper post-processing apparatus 58 constituted of a sorter or the like, an automatic duplex copying apparatus 59 serving as the original stand of the copying machine P and used to form images on both sides of the sheet S, etc. The main body 50 contains an optical system 60 for scanning the original 56, a photosensitive member 61 on which exposure by the optical system 60 and toner image formation by the developing device are effected, a transfer portion 62 for transferring a toner image to a sheet S, a fixing apparatus 63 for fixing the toner image, etc.

Next, a sheet feeding means for feeding a sheet to the image forming apparatus and a drive transmission portion for driving the sheet feeding means will be described. In FIG. 4, the sheet feeding means 1 is capable of separating and feeding the sheets S made of paper, synthetic resin, or the like one by one to the copying machine P as an image forming apparatus. In FIG. 4, the sheet feeding means 1 serving as the sheet send-out means is equipped with a pick-up roller 2 for separating and feeding the sheets S one by one, starting with the uppermost sheet, from the deck 5 serving as the sheet accommodating means in which a plurality of sheets S are stacked on a lifter plate (not shown), a feed roller 3 serving as the feed rotary member of the present invention for conveying the sheets S fed from the deck 5 by the pick-up roller 2 into the main body of the copying machine P (in the direction of the arrow a in the drawing), a retard roller 4 serving as the retard rotary member of the present invention which is opposed to the feed roller 3 and which, when a plurality of sheets S are fed from the deck 5, rotates in a direction reverse to the direction in which the sheets S are fed, separating the sheets S into individual ones, and a conveying roller pair 6 arranged in front of the copying machine P.

Further, a guide 8 is arranged in a sheet passage region 7 between the pick-up roller 2 and the roller pair made up of the feed roller 3 and the retard roller 4, and guides 9 are arranged between the roller pair made up of the feed roller 3 and the retard roller 4 and the conveying roller pair 6 and between the conveying roller pair 6 and the main body of the copying machine P, guiding and conveying each sheet S.

Figure 5:
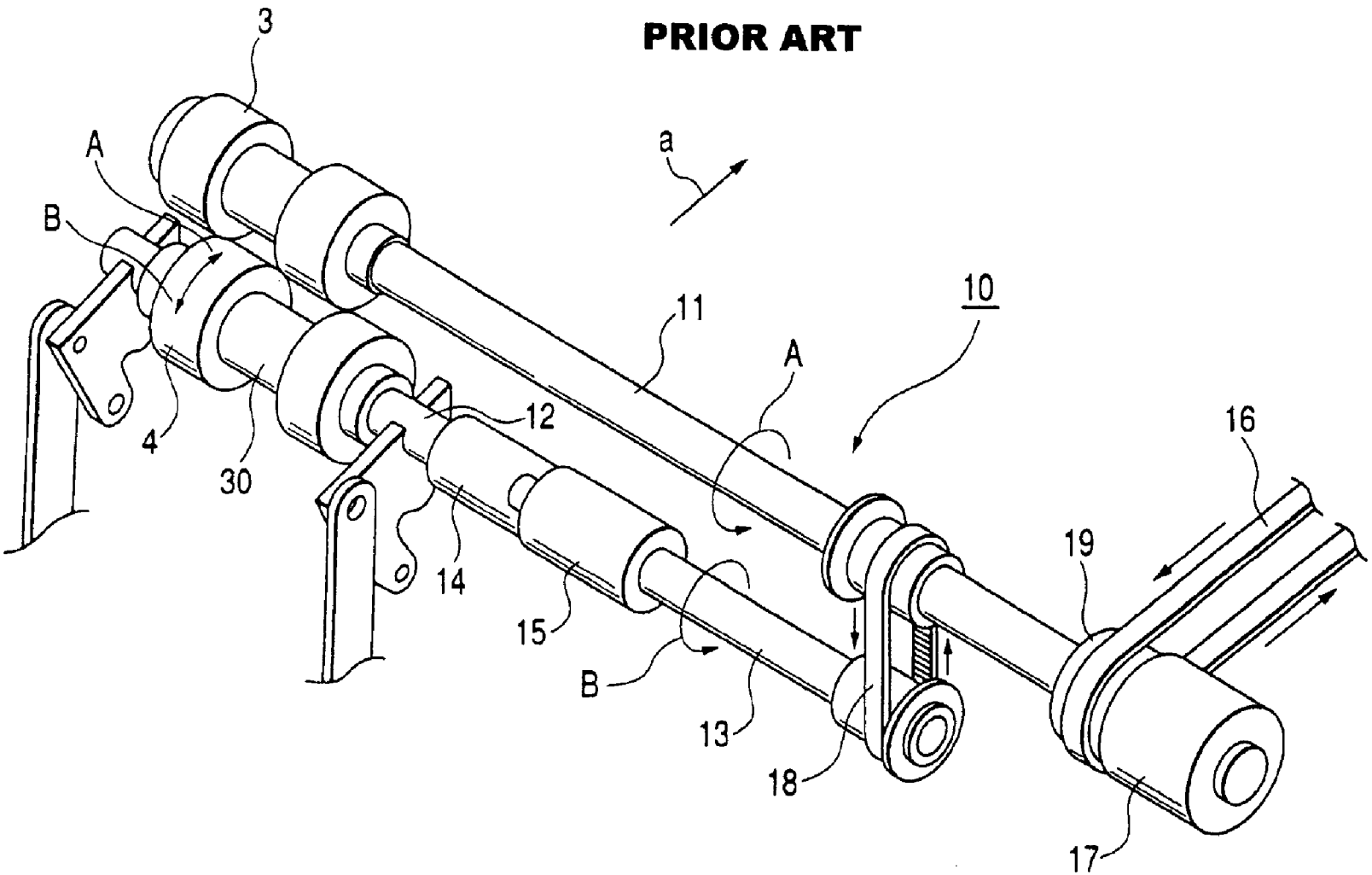
FIG. 5 PRIOR ART
FIG. 5 is a perspective view showing a drive transmission portion for driving the sheet feeding means shown in FIG. 4.
Figure 6:
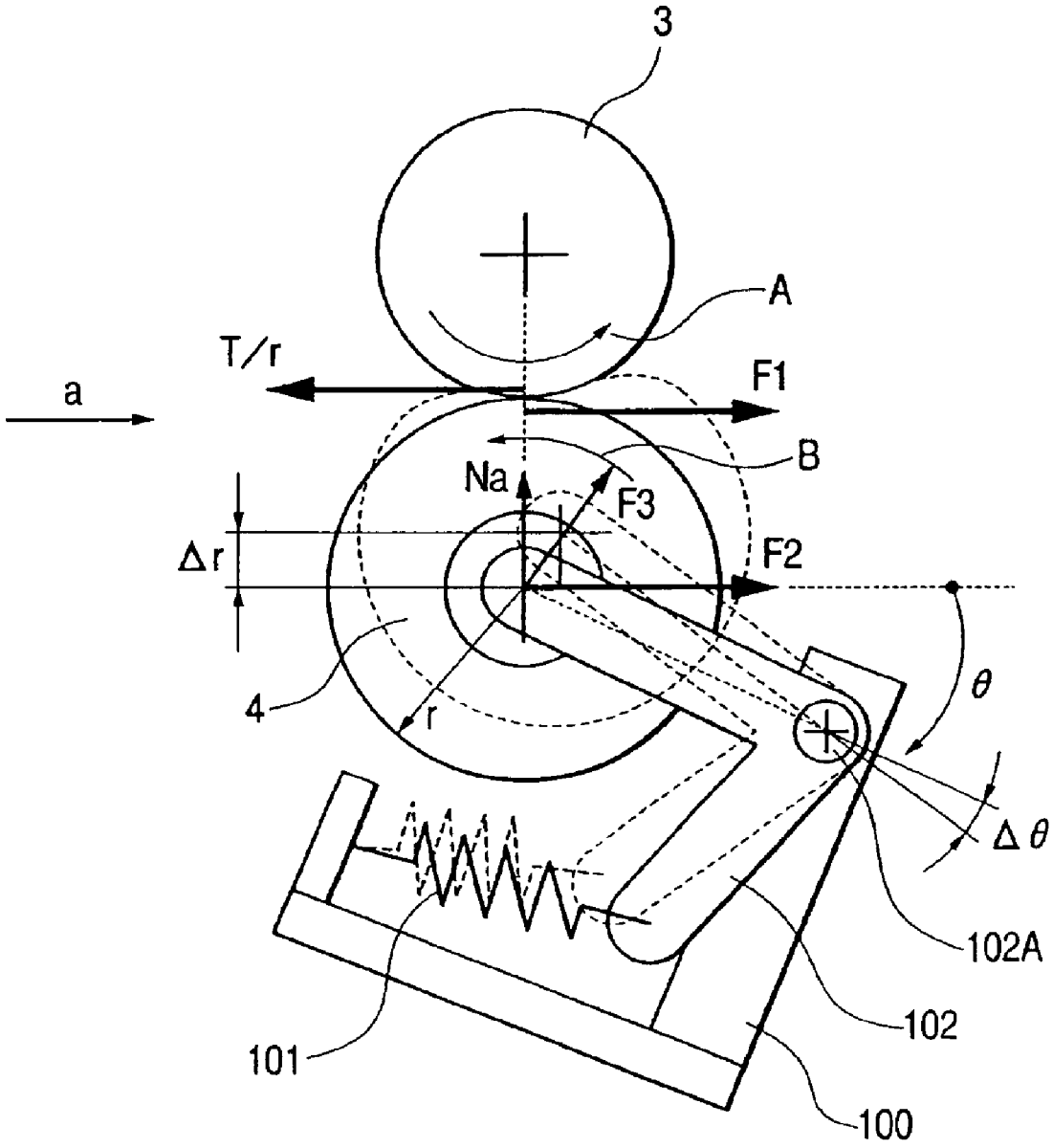
FIG. 6 PRIOR ART
FIG. 6 is a sectional explanatory view of a main portion of the sheet feeding means shown in FIG. 4.

The feed roller 3 and the retard roller 4 are driven by a drive transmission portion 10 shown in FIG. 5. Provided in parallel in the drive transmission portion 10 are a feed roller shaft 11 rotatably supporting the feed roller 3, a retard roller shaft 12 rotatably supporting the retard roller 4, and a retard roller drive shaft 13 connected to the retard roller shaft 12.

A coupling 14 and a torque limiter 15 are arranged between the retard roller shaft 12 and the retard roller drive shaft 13. Further, provided at an end of the feed roller shaft 11 is an electromagnetic clutch 17 for transmitting to the feed roller shaft 11 a driving force transmitted from a main driving means (not shown) of the copying machine P through a drive input belt 16. Further, between the feed roller shaft 11 and the retard roller shaft 13, there is stretched a retard drive belt 18 for transmitting to the retard roller shaft 13 a rotational driving force transmitted to the feed roller shaft 11.

FIG. 1 shows a main portion of the sheet feeding means of the first embodiment of the present invention. In the drawing, reference numeral 110 indicates a retard roller support arm serving as the rotary member support portion of the present invention rotatably supporting the retard roller, and reference numeral 111 indicates a spring support arm serving as the elastic member support portion of the present invention. The retard roller support arm 110 and the spring support arm 111 have at their respective connection ends a pair of gears 110A and 111A, which are in mesh with each other. Further, both the pair of gears 110A and 111A, establishing interlock using their shafts as the pivotal movement centers, are rotatably supported by a gear support plate 113.

Further, a spring 112 serving as the elastic member of the present invention is hooked onto the spring support arm. Due to this spring 112, the retard roller 4 is pressurized against the feed roller 3 through the pair of gears 110A and 111A.

Here, the arrangement of the retard roller support arm 110 is determined by the angle θ made by the line of action passing the center of the retard roller (directed in the direction of the arrow a) and the line of action connecting the center of the retard roller and the pivotal movement center of the retard roller support arm 110 (the axial center of the gear 110A). When the angle θ is 0, the range of fluctuation of the contact pressure during rotation of the feed roller 3 and the retard roller 4 as described above is 0. Further, assuming that the sign of the value of the angle θ as measured clockwise is positive, the contact pressure fluctuates so as to increase when the sign of the angle θ is positive. When the sign of the angle θ is negative, the contact pressure fluctuates to as to decrease.

Next, the driving of the feed roller 3 and the retard roller 4 by the drive transmission portion 10 will be described. The rotational driving force given by the main driving means of the main body of the copying machine P is transmitted to the drive input belt 16, and input to a pulley 19 provided in the armature portion of the electromagnetic clutch 17 that is ON/OFF-controlled according to the feed timing.

Here, the feed roller shaft 11 rotating integrally with the rotor portion of the electromagnetic clutch 17 is connected to the retard roller driving shaft 13 and the retard roller shaft 12 by a retard drive belt 18, so that the feed roller shaft 11 and the retard driving shaft 13 rotate in the same direction, and the feed roller 3 and the retard roller 4 are rotated in synchronism with each other when the feed timing is ON.

When the sheets S are fed one by one in the feeding direction (the direction of the arrow a in FIGS. 4 and 5) by the drive transmission portion 10, the torque limiter 15 makes idle rotation due to the frictional force between the feed roller 3 and the sheet S, and the retard roller 4 rotates in a direction opposite to the drive rotation direction of the retard roller driving shaft 13.

Further, when a plurality of sheets S are fed, the frictional force between the plurality of sheets S is smaller than the frictional force between the retard roller 4 and the sheets S, so that the torque limiter 15 makes no idle rotation, and the retard roller 4 rotates in the same direction as the rotation drive direction of the retard roller driving shaft 13.

As a result, of the plurality of sheets S fed, the one in contact with the feeder roller 3, that is, the uppermost sheet S, is separated from the other sheets S, thereby preventing double feeding of sheets S into the main body of the copying machine P.

When the feed roller 3 and the retard roller 4 rotate, the contact pressure of the retard roller 4 for the feed roller 3 fluctuates. This fluctuation in contact pressure will be described below.

First, for the reason stated above, when rotation drive is input to the feed roller 3 and the retard roller 4, a fluctuation pressure Na is generated as expressed by equation (2). When the retard roller 4 is formed of a soft material like a sponge, the positional relationship between the central axes of the feed roller 3 and the retard roller 4, well-balanced under static state, is changed such that the roller is crushed by the action of the fluctuation pressure Na, and the center position of the retard roller 4 is displaced by Δr. With this displacement of the center position, the displacement amount of the spring 112 is changed through the pair of gears 110A and 111A. Further, due to the change in the displacement amount of the spring 112, the contact pressure of the retard roller 4 for the feed roller 3 is changed by ΔNa. The changing amount is as follows:

$$\Delta Na \approx \alpha \cdot k \cdot \Delta r \tag{4}$$

where k: the elastic modulus of the spring 112; and

α: the speed reduction ratio (gear ratio) of the pair of gears 110A and 111A leading to an increase in the rotation angle of the spring support member 111 with respect to the rotation angle of the retard roller support arm 110.

As stated above, due to the change in the displacement amount of the spring 112, the changing amount ΔNa of the contact pressure works so as to cancel the fluctuation pressure Na, so that, by increasing the displacement amount ΔNa, it is possible to reduce the range of fluctuation of the fluctuation pressure Na of the contact pressure.

Thus, in FIG. 1, assuming that the rotational displacement of the spring support arm 111 is φ1 and that the rotational displacement of the retard roller support arm 110 is φ2, the relationship: φ1>φ2 always holds true when α>1. Thus, due to the action of the reaction force of the return force of the retard roller 4 upon drive input, the retard roller support arm 110 moves so as to approach the feed roller 3, and even if the contact pressure increases as indicated by equation (1), the spring support arm 111 rotates counterclockwise as seen in FIG. 1 to reduce the displacement amount of the spring 112, so that it is possible to reliably reduce the range of fluctuation of the contact pressure due to the drive input.

Further, when, conversely, the retard roller support arm 110 moves away from the feed roller 3 and the contact pressure decreases, the spring support arm 111 rotates clockwise as seen in FIG. 1 to increase the displacement amount of the spring 112, so that it is possible to reduce the range of fluctuation of the contact pressure due to the drive input.

Regarding this ΔNa, by making the value of the speed reduction ratio a large, it is possible to keep the range of fluctuation of the fluctuation pressure Na at a still lower level. Thus, according to this embodiment, it is advantageously possible to diminish the range of fluctuation of the contact pressure to thereby stabilize the feeding condition.

(Second Embodiment)

Figure 2:
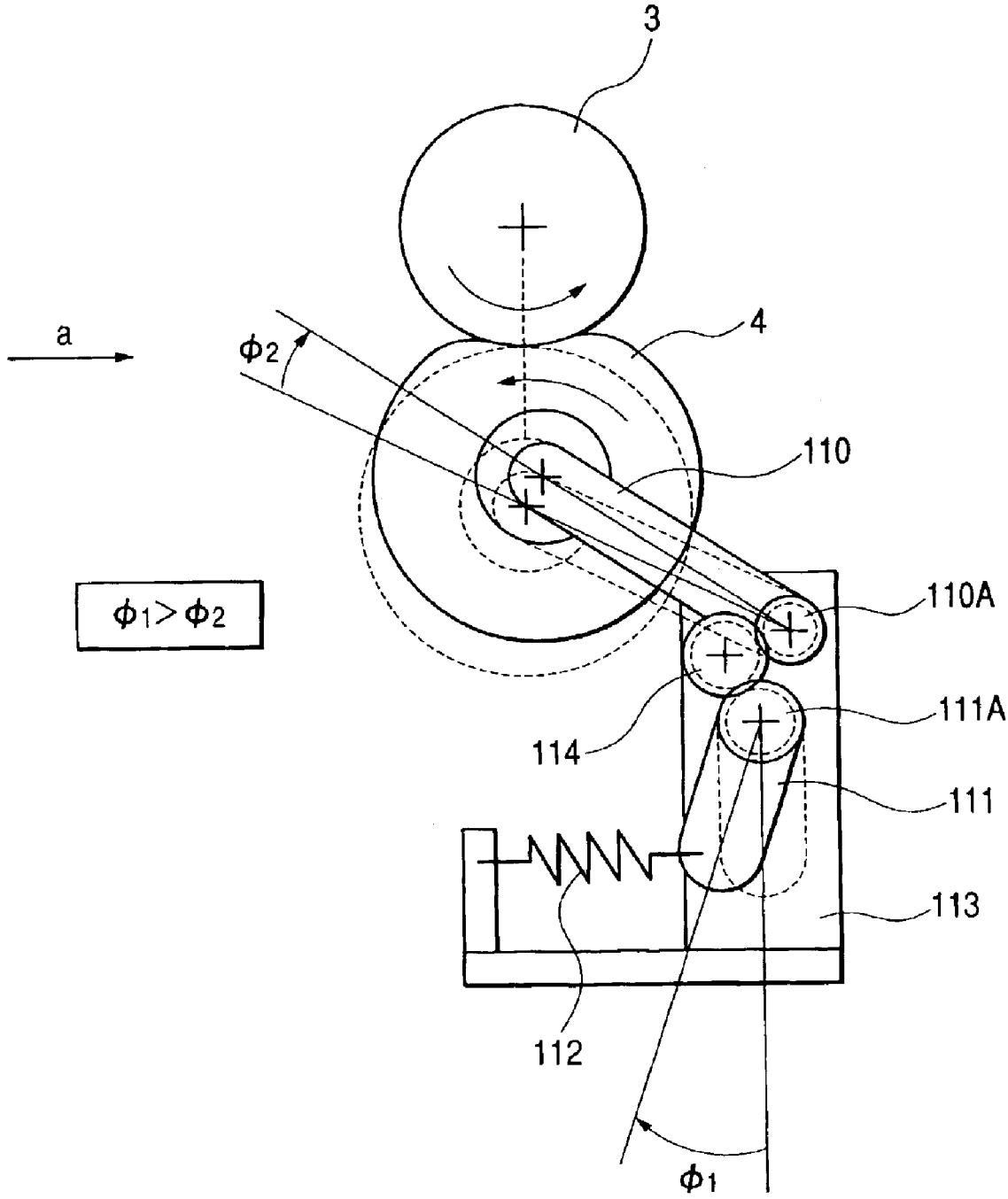
FIG. 2 is a sectional explanatory view of a main portion of a sheet feeding means according to a second embodiment of the present invention.

FIG. 2 is a sectional explanatory view of the main portion of a sheet feeding means according to a second embodiment of the present invention. In the drawing, the components which are the same as those of the first embodiment are indicated by the same reference numerals, and a description of such components will be omitted. The construction of the second embodiment is formed not only by the pair of gears 110A and 111A but also by an idler gear 114 shown in FIG. 2.

In FIG. 2, even if the retard roller support arm 110 moves so as to approach the feed roller 3 due to the action of the reaction force of the return force of the retard roller 4 upon drive input, and the contact pressure increases as calculated by equation (1), the spring support arm 111 rotates clockwise as seen in FIG. 2 to reduce the displacement amount of the spring 112, so that the range of fluctuation of the contact pressure upon drive input is reliably diminished by ΔNa calculated by equation (4). Further, even when, conversely, the retard roller support arm 110 moves away from the feed roller 3 and the contact pressure decreases, the spring support arm 111 rotates counterclockwise as seen in FIG. 2 to increase the displacement amount of the spring 112, so that the range of fluctuation of the contact pressure upon drive input is reduced.

Further, according to the second embodiment, it is possible to enhance the degree of freedom in the arrangement of the spring 112 through the arrangement and construction of the gears. Otherwise, the operation of this embodiment is the same as that of the first embodiment, so that a description thereof will be omitted.

The above-described embodiments of the present invention should not be construed restrictively. For example, while in the above embodiments the retard roller support arm 110 rotatably supports the retard roller 4, it is also possible for the forward end of the retard roller support arm 110 to pressurize the lower surface of the collar portion 30 of the roller in FIG. 4 in the direction of the feed roller 3. Further, while, as shown in FIGS. 1 and 2, in the above embodiments the retard roller pivot position (the center of the gear 110A) is situated on the downstream side of the retard roller 4 with respect to the sheet conveying direction (the direction of the arrow a), it is also possible for the pivot to be situated on the upstream side of the same. Further, the image forming apparatus to which the sheet feeding apparatus of the present invention is applicable is not restricted to a copying machine; it is also applicable, for example, to a printer or a facsimile apparatus.

What is claimed is:

1. A sheet feeding apparatus comprising:

a feed roller rotationally driven in a sheet feeding direction;

a retard roller to which drive is transmitted through a torque limiter and which is rotationally driven in a direction opposite to the sheet feeding direction with a predetermined torque;

a roller support member supporting the retard roller and provided to be pivotally movable;

a spring support member onto which a spring is hooked and which is provided to be pivotally movable; and a gear train provided between respective pivots of the roller support member and the spring support member and adapted to transmit the pivotal movement of the roller support member to the spring support member, wherein a gear ratio of the gear train is set such that a pivotal movement angle of the spring support member is larger than that of the roller support member.

2. A sheet feeding apparatus according to claim 1, wherein said spring support member is pivotally moved in an opposite direction as a pivotal movement of said roller support member.

3. A sheet feeding apparatus according to claim 1, wherein said spring support member is pivotally moved in a same direction as a pivotal movement of said roller support member.

4. An image forming apparatus comprising:

a feed roller rotationally driven in a sheet feeding direction;

a retard roller to which drive is transmitted through a torque limiter and which is rotationally driven in a direction opposite to the sheet feeding direction with a predetermined torque;

a roller support member supporting the retard roller and provided to be pivotally movable;

a spring support member onto which a spring is hooked and which is provided pivotally movable;

a gear train provided between respective pivots of the roller support member and the spring support member and adapted to transmit the pivotal movement of the roller support member to the spring support member; and image forming means for forming an image on a sheet separated by the feed rotary member and the retard rotary member, wherein a gear ratio of the gear train is set such that a pivotal movement angle of the spring support member is larger than that of the roller support member.

5. An image forming apparatus according to claim 4, wherein said spring support member is pivotally moved in an opposite direction as a pivotal movement of said roller support member.

6. An image forming apparatus according to claim 4, wherein said spring support member is pivotally moved in a same direction as a pivotal movement of said roller support member.

* * * * *

UNITED STATES PATENT AND TRADEMARK OFFICE

CERTIFICATE OF CORRECTION

PATENT NO. : 6,942,210 B2
DATED : September 13, 2005
INVENTOR(S) : Ryoichi Kawasumi It is certified that error appears in the above-identified patent and that said Letters Patent is hereby corrected as shown below:

Title page,
Item [56], References Cited, FOREIGN PATENT DOCUMENTS,
"06263280 A" should read -- 06-263280 A --.

Figure 7:
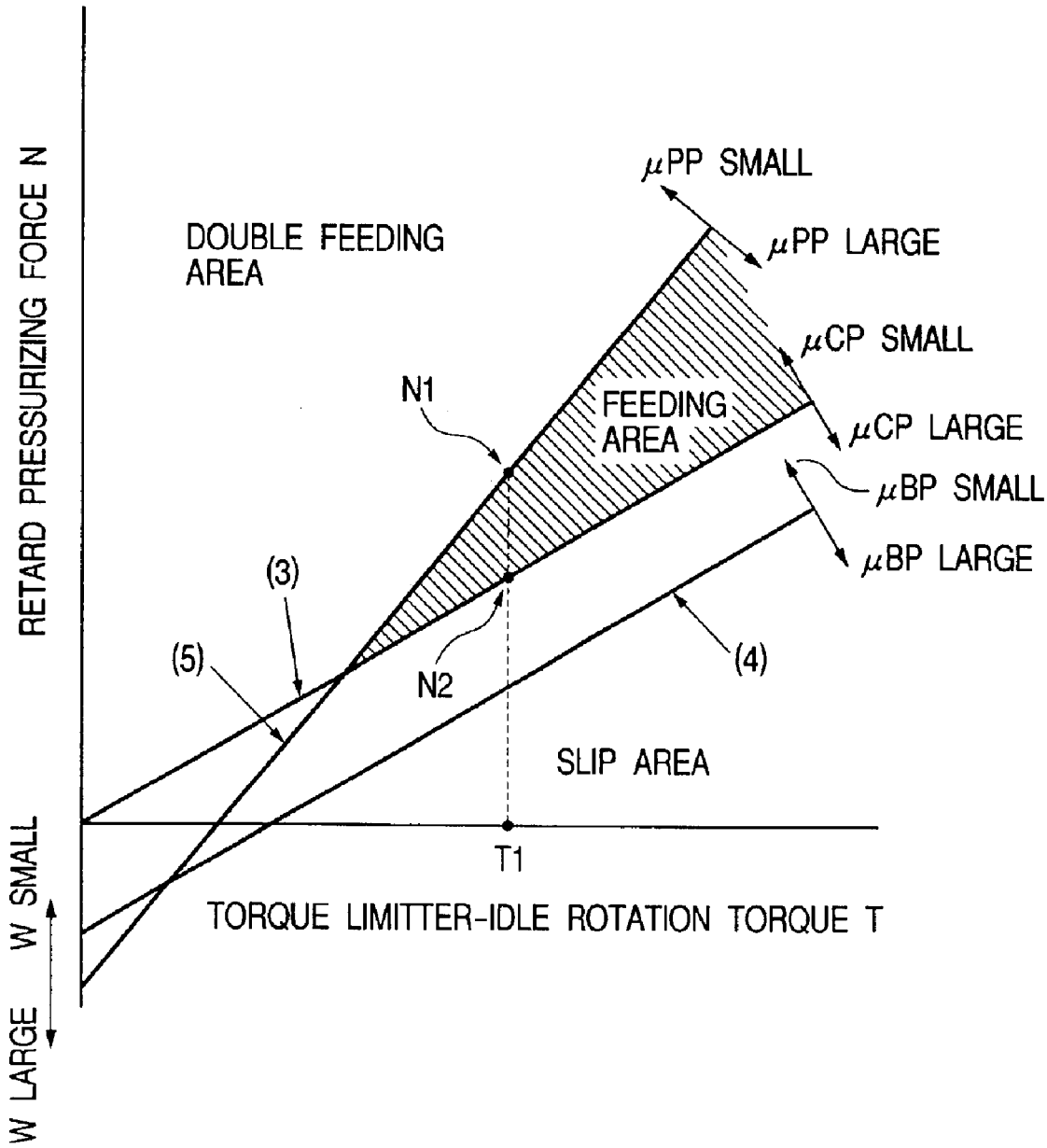
FIG. 7 is an explanatory diagram showing a sheet feeding area in a retard separation system.
Figure 8:
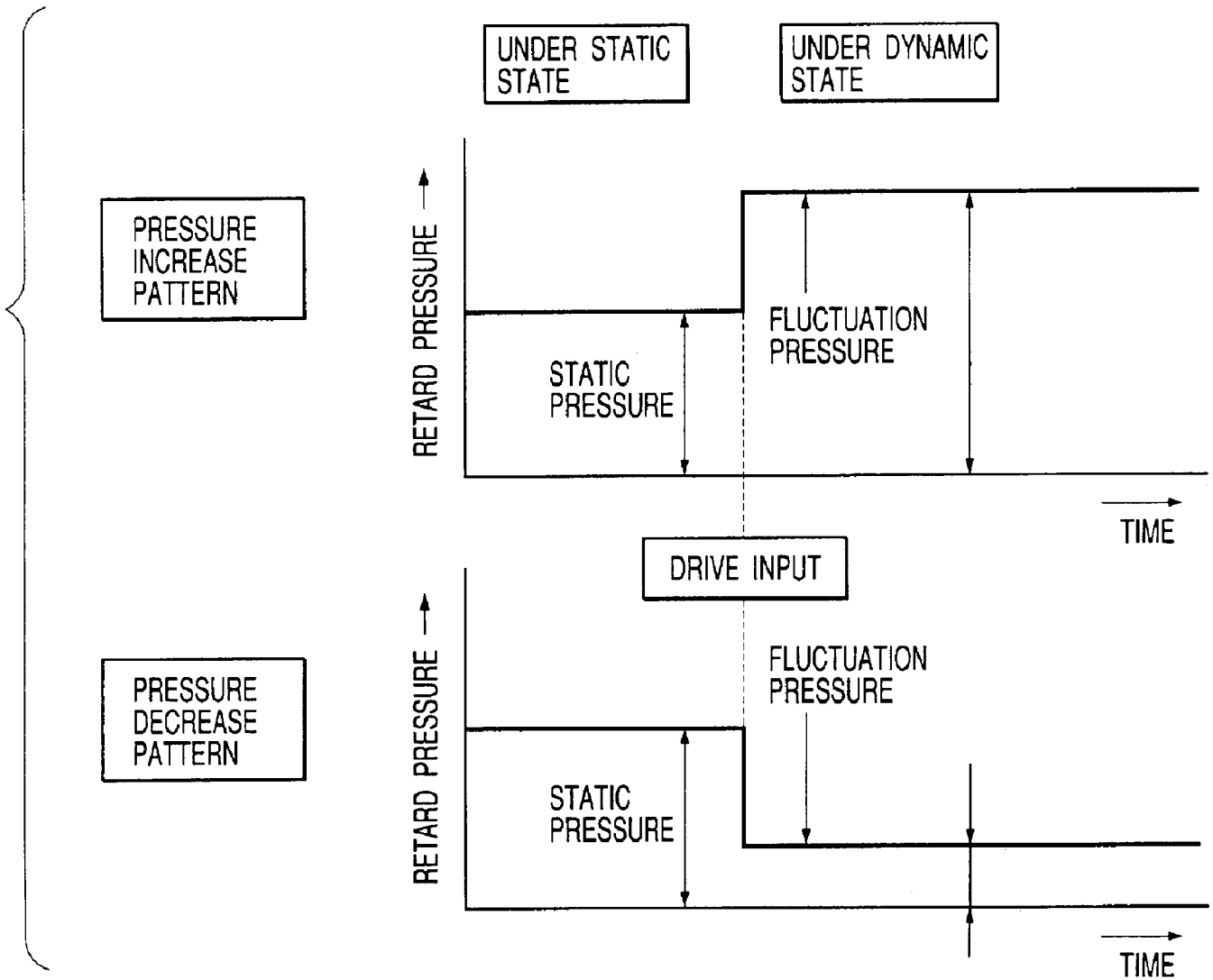
FIG. 8 is a schematic diagram showing a variation in contact pressure for a feed roller and a retard roller due to drive input.
Figure 9:
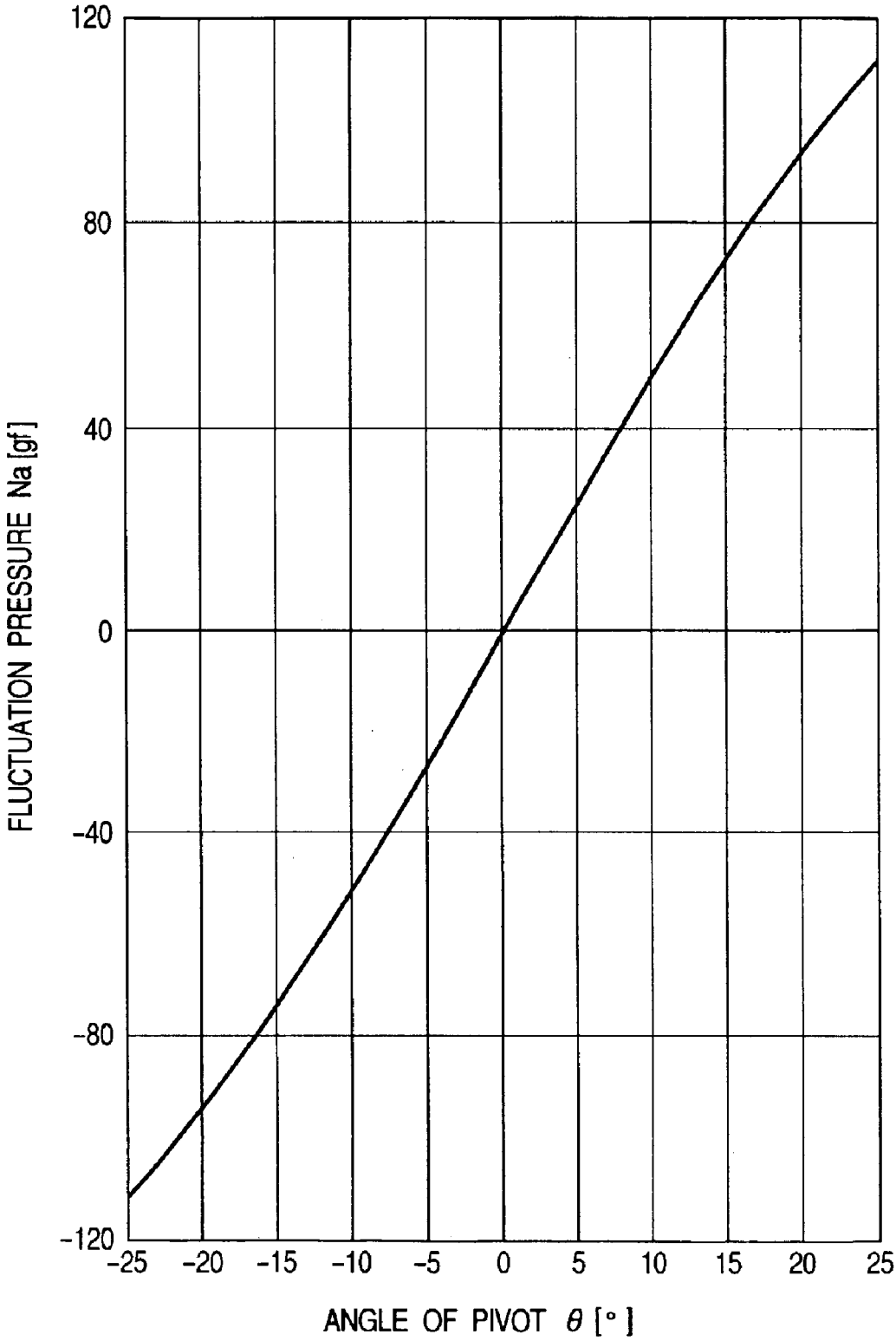
FIG. 9 is an explanatory view showing a variation amount in contact pressure when the effective radius of the retard roller is fixed, with the horizontal axis indicating the angle θ of the pressurizing arm shown in FIG. 6.
Figure 10:
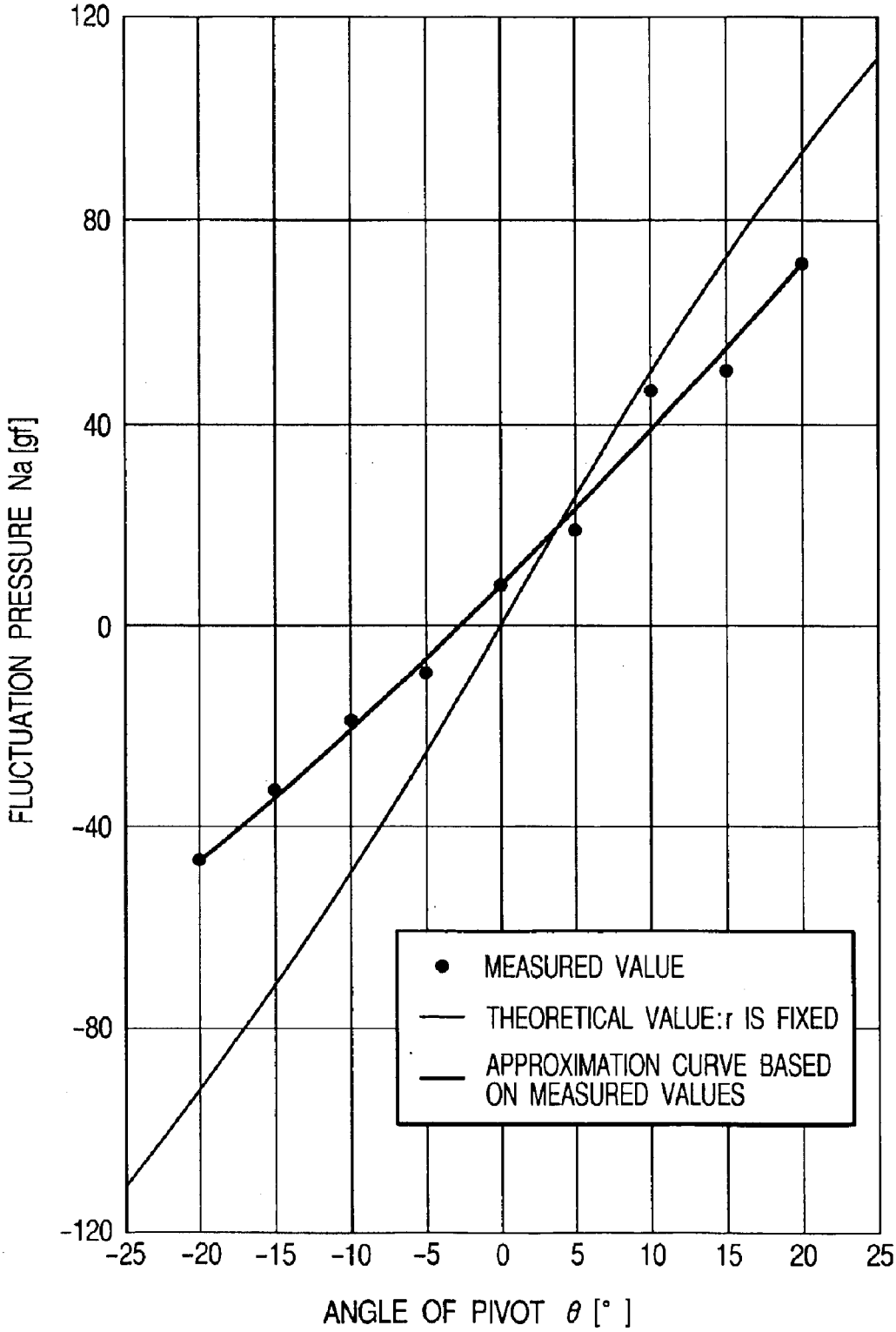
FIG. 10 is an explanatory view showing a variation amount in contact pressure when the effective radius of the retard roller is not fixed, with the horizontal axis indicating the angle θ of the pressurizing arm shown in FIG. 6.

Drawings,
Figure 7, "LIMITTER-IDLE" should read -- LIMITER-IDLE --.

Column 2,
Line 50, "of the" (2nd occurrence) should be deleted.

Column 8,
Line 51, "ratio a" should read -- ratio α --.

Signed and Sealed this

Twenty-fourth Day of January, 2006

JON W. DUDAS
*Director of the United States Patent and Trademark Office*